US006012505A

United States Patent [19]

Wurz et al.

[11] Patent Number: 6,012,505

[45] Date of Patent: Jan. 11, 2000

[54] ADJUSTABLE CANOPY

[76] Inventors: Gerald Wurz, Teschnergasse 17, A-1180; Norbert Kautzky, Schöffelgasse 26-28, A-1180, both of Vienna, Austria

[21] Appl. No.: 09/077,765

[22] PCT Filed: Dec. 6, 1996

[86] PCT No.: PCT/AT96/00242

§ 371 Date: Jul. 17, 1998

§ 102(e) Date: Jul. 17, 1998

[87] PCT Pub. No.: WO97/21014

PCT Pub. Date: Jun. 12, 1997

[30] Foreign Application Priority Data

Dec. 6, 1995 [AT] Austria ..... 1984/95
Dec. 6, 1995 [AT] Austria ..... 1985/95

[51] Int. Cl.[7] ..... E04F 10/06

[52] U.S. Cl. ..... 160/66; 160/122; 242/594; 135/97

[58] Field of Search ..... 160/66, 46, 265, 160/120, 121.1, 122; 52/63, 222; 135/90, 97, 115, 117; 242/594

[56] References Cited

U.S. PATENT DOCUMENTS

| | | | |
|---|---|---|---|
| 721,993 | 3/1903 | Arnett | 160/121.1 |
| 2,350,758 | 6/1944 | Heuer | 160/121.1 |
| 3,510,996 | 5/1970 | Popil . | |
| 3,952,758 | 4/1976 | Addison et al. . | |
| 4,487,212 | 12/1984 | Moore . | |
| 4,724,882 | 2/1988 | Wang . | |
| 5,287,908 | 2/1994 | Hoffmann et al. | 160/265 |
| 5,437,298 | 8/1995 | Lin | 160/66 |
| 5,524,693 | 6/1996 | Hamilton | 160/120 |
| 5,778,613 | 7/1998 | Thomson | 52/63 |

FOREIGN PATENT DOCUMENTS

| | | |
|---|---|---|
| 2431827 | 2/1980 | France . |
| 2668195 | 4/1992 | France . |
| 3029465 | 3/1982 | Germany . |

*Primary Examiner*—Blair M. Johnson
*Attorney, Agent, or Firm*—Ladas & Parry

[57] ABSTRACT

In the described awning of variable size comprising a canvas (1, 2) which can be wound up on a shaft (3) provided with a drive, the canvas (1, 2) is fastened to the shaft (3), which has only one single drive, at a parting or folding line, and for winding up or unrolling the canvas parts (1, 2) provided by the parting or folding line, at least one tensioning rope (6, 6') is provided which engages at the canvas (1, 2) and which can be coiled up on the shaft (3) on at least one coiling pulley (5, 5') seated on the shaft.

39 Claims, 5 Drawing Sheets

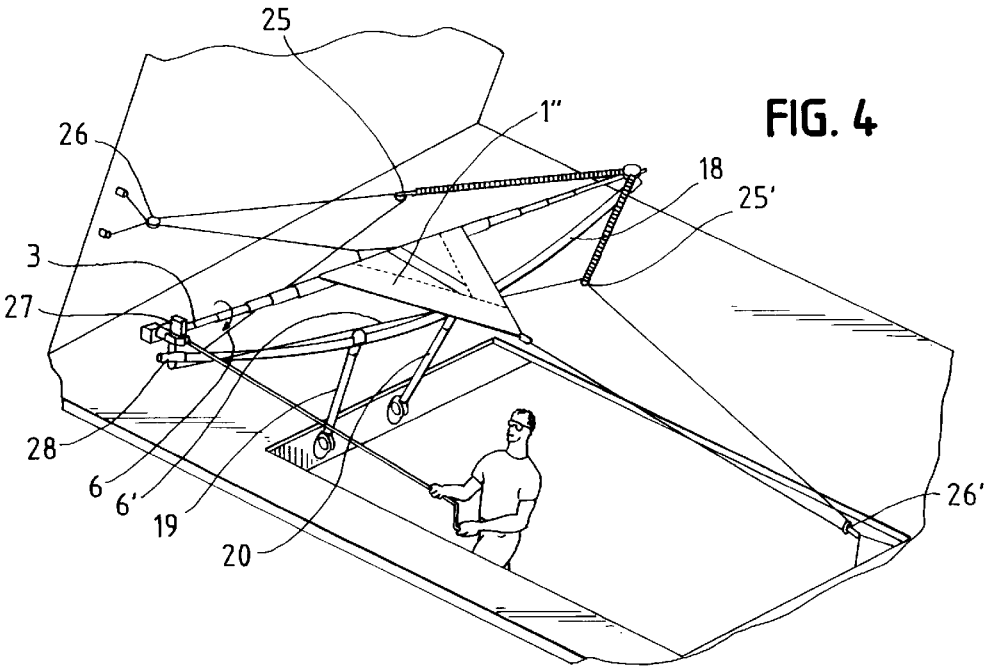
FIG. 4
FIG. 5
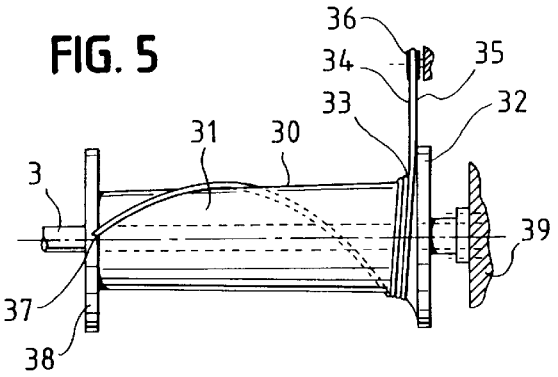
FIG. 7
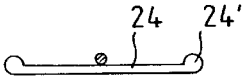
FIG. 6
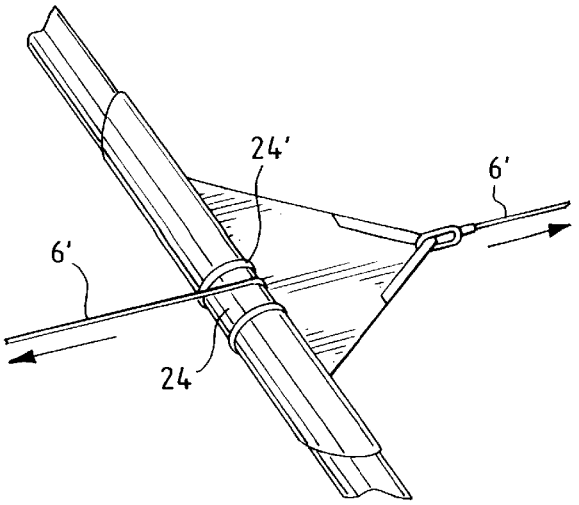

FIG. 8
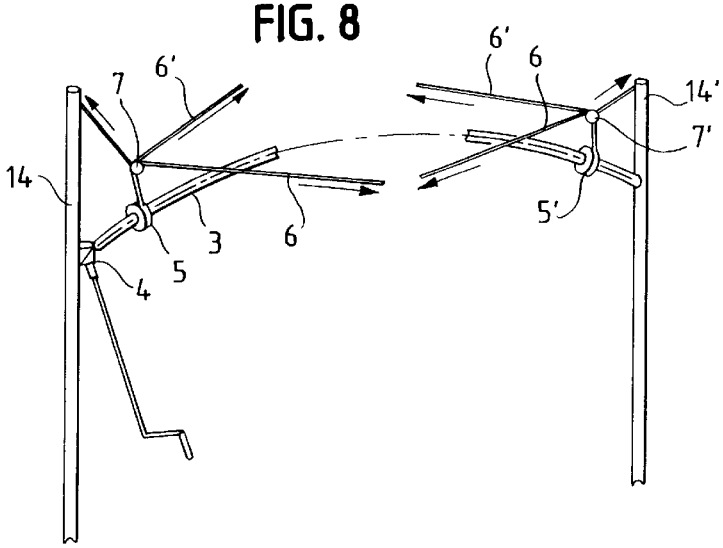
FIG. 9
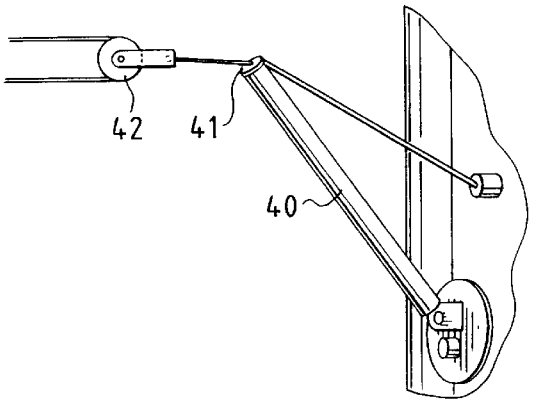
FIG. 10
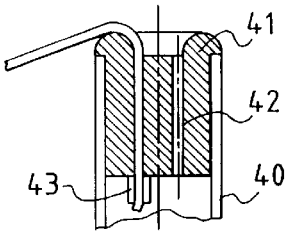
FIG. 10a
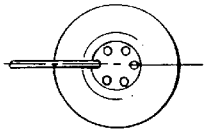
FIG. 12
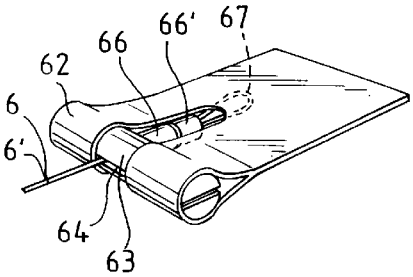
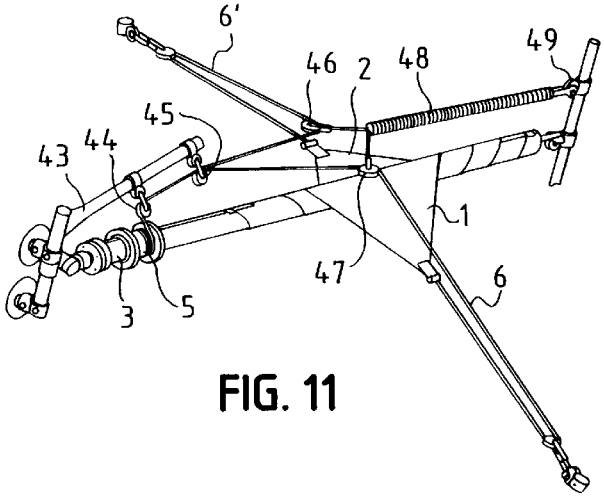
FIG. 11

ADJUSTABLE CANOPY

The invention generally relates to an awning of variable size, e.g. a sun shade, and in particular a variable awning comprising a canvas capable of being rolled up on a shaft provided with a drive.

In known awning arrangements, a canvas is arranged on a rotatable shaft which is rotatable by hand or by means of a motor, one rim of the canvas being affixed to the shaft. From this shaft, the canvas can be drawn out in one direction by using a cantilevering carrier. However, these known arrangements are only poorly suited for roofing over large areas because they sag too much and because very high forces act on the cantilevering carrier and its fastening elements because of the cantilevered arrangement.

It is thus an object of the invention to provide an awning of the initially defined type with which large areas can be roofed, in which it is possible to keep the canvas taut by a respective introduction of force, without overloading the carrying structures.

It is furthermore an object of the invention to provide a rope coiling pulley which is particularly suitable for the awning of the invention and which allows for a tight coiling up of the tensioned ropes.

The invention is based on the consideration that it would be advantageous to suspend or support the canvas at its center and at its ends, while simultaneously it should always be as taut as possible. Such an arrangement may then cover larger areas, the suspension points of the corners of the canvas which can be drawn out or which have been drawn out merely having to accommodate the tention of the canvas and a small part of the weight of the unrolled canvas.

The awning according to the invention of the initially defined type thus is characterized in that in the region of a parting or folding line, the canvas is fastened to the shaft which is provided with a single drive only, and that for rolling up and unrolling the canvas parts provided by the parting or folding line, at least two tensioning ropes are provided which engage on the canvas parts and are capable of being coiled up on the shaft, preferably on at least one coiling pulley seated thereon.

Thus, in case of the present awning, in particular sun-shade, the canvas (a sailcloth or the like) either is folded along a line, e.g. a diagonal line of symmetry, whereby two canvas parts are formed, or it consists of two separate parts whose contacting rim lines form a type of "folding" line or correspond to the folding line; the canvas parts may be differently sized and/or differently shaped. In the region of the folidng line (or parting line), the canvas or the canvas parts, respectively, is (are) fastened to the drivable shaft; to wind up or unroll, respectively, the canvas parts, preferably two tensioning ropes are provided, each engaging on one canvas part and capable of being rolled up on the shaft or on coiling pulleys seated on the shaft. Suitably, the canvas is provided with sail-board-type flat sections, e.g. of glass fiber reinforced plastic material, in parallel to the rolling-up shaft.

Rolling in a folded cloth is, e.g., known for headsails of boats, where the cloth is rolled up on the forestay and can be drawn out at unrolling by means of two separate tensioning devices to a so-called butterfly sail, whereby it is particularly suitable for sailing in trade wind. However, this field of application is far removed from the field of application of the invention which relates to awnings, preferably sun shades. Moreover, only a single drive associated to a shaft is used in the invention in the unrolling and rolling up operation.

By the "double", optionally two-layered (in case of a respective overlap of the canvas parts) rolling up of the canvas, starting in the region of the folding or parting line, also the most varying designs are possible for the shape of the awning. For a good compensation of forces it is advantageous if the points of the canvas parts, at which the respective tensioning rope device is fastened, lie on one and the same line which extends at a right angle to the shaft, as well as if the canvas parts are symmetrical to each other. On the other hand it is suitable for certain shapes if the points of the canvas parts, at which the respective tensioning rope device is fastened, lie on two different lines which extend in parallel to each other and at a right angle to the shaft, or if in the unrolled state the canvas parts are offset relative to each other on the folding line. For rolling in and unrolling it is also advantageous if the canvas parts are triangular.

To compensate for the different uncoiling lengths and for tensioning the tensioning ropes, at least one elastic element, in particular a helical spring, may be provided. Here, it is particularly advantageous if the elastic element is arranged such that it draws the two (or more) tensioning ropes towards each other, and in case of a single elastic element, two deviation pulleys or a double pulley are (is) attached to this elastic element, one tensioning rope each being guided thereover. Furthermore it is suitable if the point of attachment of the elastic element is adjustable in terms of height above the shaft and if the two tensioning ropes are guided to one single coiling pulley over guiding rollers fastened to a cantilevering carrier so that the tensioning ropes leading to the coiling pulley are held sufficiently high above the awning. On the other hand it is advantageous for a uniform tensioning of the tensioning rope devices if two elastic elements are arranged such that they draw the two tensioning rope devices towards each other, each elastic element at each end thereof being connected with one of the tensioning ropes via a tensioning pulley fastened thereto.

An embodiment which lends itself well for roofing over particularly large areas is characterized in that laterally of the rolled-in canvas, one coiling pulley each is fastened to the drive shaft, wherein from each of the two coiling pulleys two ropes fastened thereto depart, each one of these ropes belonging to the one or to the other tensioning rope device and being guided over deviation pulleys suspended at fixed points, e.g. uprights, to tensioning pulleys which resiliently draw the two tensioning ropes towards each other, via deviation pulleys suspended at further fixed points to one tensioning pulley each fastened on each canvas part and from there extending via deviation pulleys and tensioning pulleys to the other coiling pulley; there, the course of the two tensioning ropes may be similar and symmetrical.

For a stable attachment it is advantageous if the shaft is fixedly mounted in bearings at each of its two ends, e.g. on an upright, one of the bearings being designed as a motor drive or as a manual drive. For an especially flexible application, particularly in case of smaller awnings, it is, on the other hand, also suitable if the shaft is mounted on a bow spanning the former, which bow in turn is held by fixedly attached carriers. It has, moreover, proven advantageous if only one single coiling pulley is seated on the shaft, each tensioning rope departing from this coiling pulley extending via a deviation pulley to tensioning pulleys and further on to deviation pulleys seated at fixed points and from there to the tensioning corners of the canvas parts.

It is furthrmore conceivable that the drawn-out canvas parts do not extend according to a common plane, but that they are capable of being drawn towards each other or drawn out at an angle deviating from 180°, e.g. to a type of tent roof.

Furthermore, it is suitable if each of the two tensioning ropes, departing from the coiling pulleys, at first is guided over a pulley which is fixedly suspended above or below the shaft bearing, the tension in the rope being chosen such that a desired bend of the shaft, preferably an upward bend, is attained. By such a bend of the shaft, sagging of the canvas parts can be counteracted.

Furthermore it is advantageous if the deviation pulleys and, optionally, the tensioning pulleys, comprise stationary side plates arranged laterally of the pulley proper and having a substantially larger diameter, which prevent the rope from escaping.

Moreover, it is advantageous, if four uprights carrying the canvas and the tensioning ropes are provided, two diagonally oppositely arranged uprights carrying the drive shaft and the two other uprights carrying rope pulleys for deviation. In this case, the uprights can be configured as guyed poles, in particular tube poles.

For reasons of flexibility, it is furthermore suitable if the coiling pulleys are locally displaceable.

It has also proven advantageous if on each of the two tensioning ropes or on their sites of attachment, respectively, at least one pre-determined breaking point is provided to protect against an excessive load, e.g. by wind pressure.

To adjust the awning, it is advantageous if the shaft on at least one of its ends is displaceably and/or Cardanically mounted.

Furthermore, it is suitable if in case of canvas parts of different lengths, a chafe protection strip, optionally comprising lateral beads, is provided on the longer canvas part, on which the tensioning rope of the shorter canvas part coils up. Moreover, each part of the canvas may be provided with rim protection strips which are dimensioned such that they cover the canvas in the rolled-up state, whereby the canvas is automatically protected in the rolled-in state.

To ensure an orderly, tight coiling up of the tensioning ropes despite the tension prevailing in the same, an advantageous embodiment is provided which is characterized in that the or each coiling pulley is slightly conical in respect of its axis of rotation, the cone angle relative to the axis being preferably less than 1°, and that at its thicker end the coiling pulley merges with a curvature into an end plate of larger diameter and that the supply of the rope or ropes to be coiled up occurs tightly along the end plate in the region of the largest diameter of the curvature, the rope or ropes to be coiled up being attachable or attached in the region of the thinner end of the coiling pulley, preferably at an end plate located there.

It should be mentioned here that for an interim storage of threads in case of textile yarn reels it is known to provide reeling drums with decreasing diameters, cf. e.g. DE 31 23 760 A, DD 221 984 A and CH 624 362 A; this type of reeling up intended for textile devices, however, operates only with threads which are continuously supplied or withdrawn and which are not fastened with one end thereof to the reeling drum.

To keep the course of the rope simple also in case of two or more ropes, it is suitable if these ropes are guided over multiple pulleys or pulleys having several flutes.

For a space-saving accommodation of a drive it is furthermore suitable if the, or one, coiling pulley, respectively, comprises an inwardly arranged electric motor driving its external jacket.

It is also advantageous if the sliding capacity of the rope or ropes to be coiled up is matched to the sliding capacity of the pulley jacket and the radius of curvature of the transition from the jacket surface to the end plate so that the rope windings at the approximately largest diameter of curvature create a sufficiently high pressure force directed towards the roller axis onto the already previously coiled up rope windings, whereby these rope windings are continously pushed onto the roller jacket towards the thinner end.

It has furthermore proven suitable if anchoring ropes are fastened to uprights or the like of tube-shaped configuration by means of plugs inserted in the tube end, which plugs engage over the tube end and comprise a number of, e.g. circularly arranged, bores, the anchoring ropes being guided through these bores and provided with pressed-on sleeves below the same which prevent slipping-out.

Furthermore, it is suitable if for fastening the ropes on the canvas parts, double straps fastened thereto are provided through which a slotted bolt is inserted, the rope being inserted in the slot thereof and being provided with pressed-on sleeves therebehind which hold together a rope loop.

Finally, it is advantageous if the shaft on which the canvas or the canvas parts can be wound up consists of a grooved tube, preferably a steel tube, the canvas being fastened to the tube by means of a rand-type strap inserted in this groove.

The invention will now be explained in more detail by way of preferred exemplary embodiments illustrated in the drawings, to which, however, it shall not be restricted.

FIGS. 1*a* to 1*d* schematically illustrate various possible basic shapes of an awning;

FIGS. 2 and 2*a* are illustrations of an awning comprising a canvas rolled up on a shaft and having extractable corners pointing in opposite directions, FIG. 2*a* showing the shadows of the arrangement cast on a platform roof of a building to better illustrate the former;

FIGS. 3 and 3*a* show the canvas in the unrolled state in illustrations corresponding to FIGS. 2 and 2*a*, with the canvas casting a large shadow;

FIG. 4 is an illustration of a different embodiment of an awning comprising a modified attachment of the drivable shaft;

FIG. 5 is a view of a coiling drum seated on the shaft and which serves to coil up the tensioning ropes for the canvas;

FIGS. 6 and 7 being detail representations of an embodiment comprising a chafe protection strip having lateral raised portions and which has the purpose of protecting the canvas in respect of the rope to be coiled up, if the parts of the canvas have different lengths;

FIG. 8 illustrates the generation of the action of force for bending the drive shaft by correspondingly suspending deviation pulleys on uprights which carry the drive shaft;

FIG. 9 is a detailed illustration of one embodiment of an upright as a guyed pole;

FIG. 10 shows, in schematical sectional representation and in top view, a fastening arrangement of the anchoring ropes on an upright;

FIG. 11 is an illustration of a suspension of the shaft ends on cantilevering adjustable arms, which may, e.g., be attached to a wall, wherein a grooved aluminum tube or a galvanized grooved steel tube accommodates the rand-type strap of the canvas; and FIG. 12 is an illustration of a double strap for attaching a rope to a canvas.

Figure 1A:
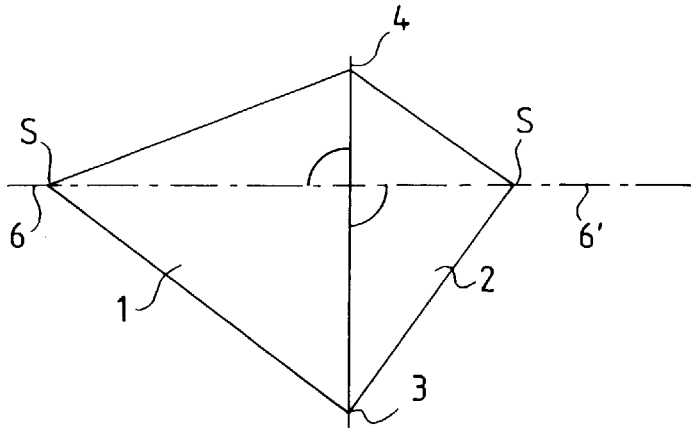
Figure 1B:
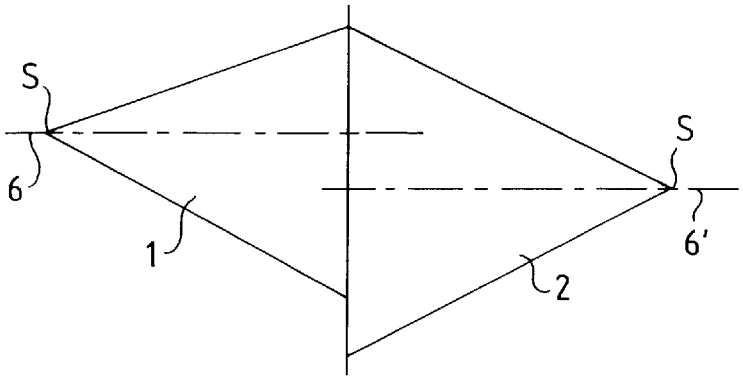
Figure 1C:
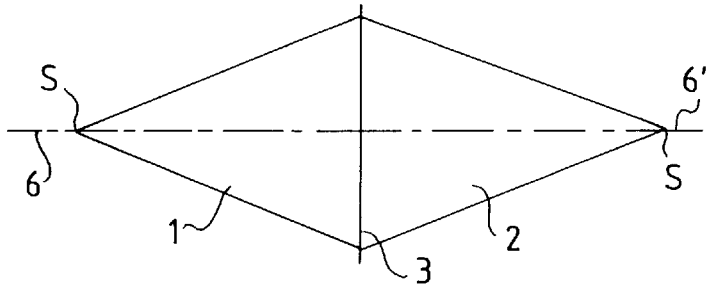
Figure 1D:
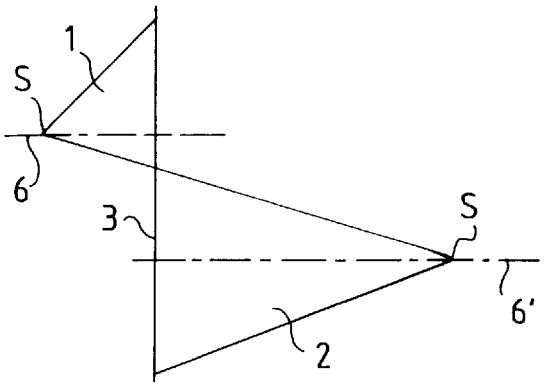

In FIG. 1*a*, a sun-shade canvas having two canvas parts 1, 2 is illustrated which are different in shape and size, yet both of their tips S, at which tensioning ropes 6, and 6', respectively, engage, lie on one and the same dot-and-dash line which extends at a right angle to the axis of a shaft 3. According to FIG. 1*b*, the directions of tensioning (ropes 6, 6') extending through the tips S of the canvas parts 1, 2 may also be in parallel one beside the other, wherein the canvas parts 1, 2 may be of different shape and size and may be shifted relative to each other on the shaft axis. A completely symmetrical arrangement of the canvas parts 1, 2 is illustrated in FIG. 1*c*. In contrast thereto, FIG. 1*d* shows an arrangement of the canvasses or canvas parts 1, 2, in which both are completely offset relative to each other in the unrolled state. All these basic canvas arrangements can be used within the scope of the invention. The canvas parts 1, 2 can be fastened to the shaft 3 along their folding line or along their edges (in case of separate canvas parts) in a manner known per se which therefor is not further illustrated. Preferably, the shaft 3 consists of a grooved tube, the groove serving to fasten the canvas parts by means of a rand-type strap provided thereon, by inserting the latter into this groove.

Figure 2:
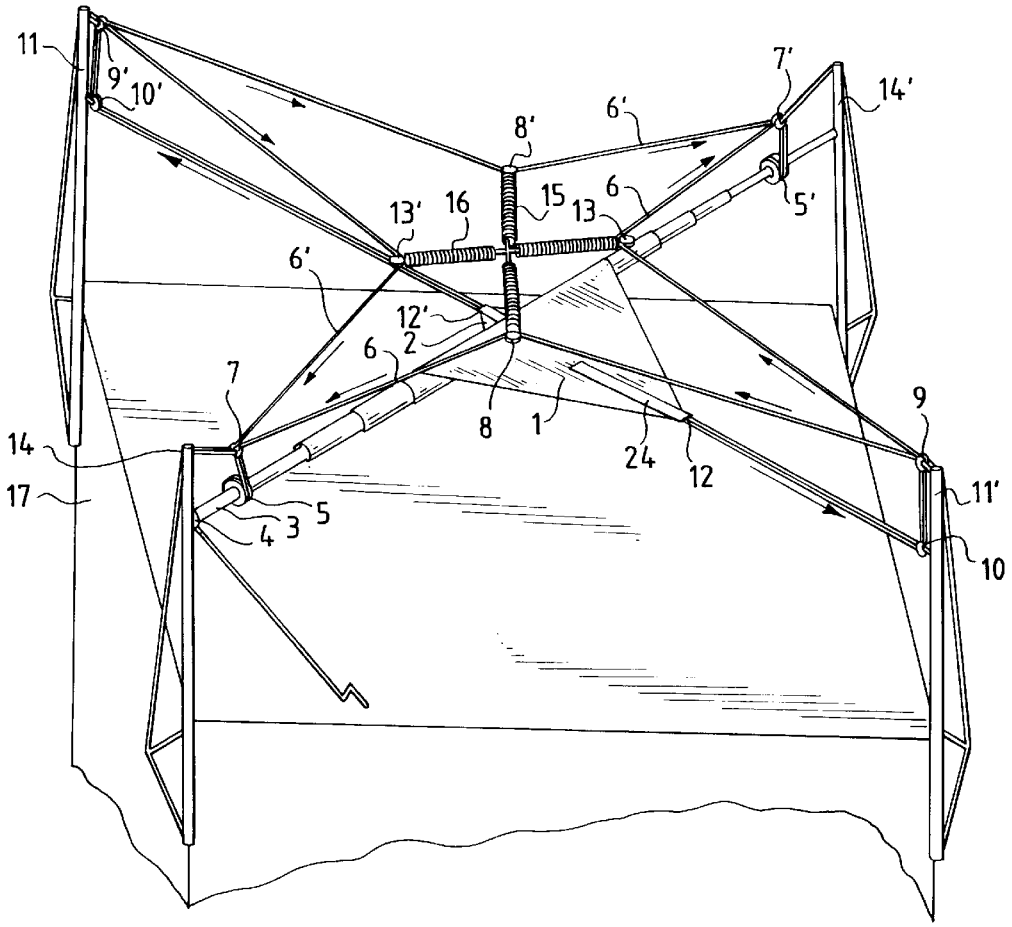

In FIG. 2, the two diagonally opposite corners of a folded canvas rolled up on a shaft 3 are illustrated, which canvas consists of two differently sized parts 1, 2. The shaft 3 can be rotated by a drive 4, and coiling pulleys 5, 5' are fastened to the shaft, and the preferred configuration of the coiling pulleys will be explained below in more detail with reference to FIG. 5. From each coiling pulley 5, 5', two tensioning ropes 6, 6' depart. Since in this embodiment, the two canvas parts 1, 2 are different in length in tensioning direction (cf. also FIG. 3), the longer canvas part 1 has a protective strip 24 attached thereto on which the rope 6' of the shorter canvas part 2 coils up. Departing from the one coiling pulley 5, the tensioning rope 6 extends over a deviation pulley 7 suspended on an upright 14 and over a tension pulley 8 to an upper deviation pulley 9 on an upright 11'. The latter may consist of two independently rotatable pulleys. Then the tensioning rope 6 extends from the deviation pulley 9 to a deviation pulley 10 of the same type on upright 11' and further on over a tensioning pulley 12 on the canvas part 1 and then back to the deviation pulleys 10, 9, the two tensioning rope parts leading to the tensioning pulley 12 moving in the same direction. Then the tensioning rope 6 leads over a tensioning pulley 13 and a deviation pulley 7' that is appended to an upright 14' to the other coiling pulley 5' to which it is fastened.

In analogous manner, the other tensioning rope 6' leads from the one coiling pulley 5 to which it is fastened, over the deflection pulley 7 and a tensioning pulley 13', then over deviation pulleys 9', 10' fastened on an upright 11 to a tensioning pulley 12' at the corner of the smaller (shorter) canvas part, and around this tensioning pulley 12' back to the deviation pulleys 10', 9' and from there on to a tensioning pulley 8' as well as to deviation pulley 7' at upright 14' and, finally, to the other coiling pulley 5'. The two ends of the two tensioning ropes 6, 6' are fastened to the coiling pulleys 5, 5'. Upon rotation of the shaft 3 caused by the drive 4 (e.g. schematically illustrated by means of a crank) in clock-wise direction indicated by the arrows at the two coiling pulleys 5, 5' (viewed from the left-hand side in FIG. 2), the canvas parts 1, 2 are drawn off the shaft 3 by the tensioning ropes 6, 6'. Elastic elements 15, 16, e.g. springs, in particular helical or coil springs, keep the tensioning ropes 6, 6' tensioned. (As illustrated in FIG. 11, also merely one spring 48 may be arranged).

Figure 2A:
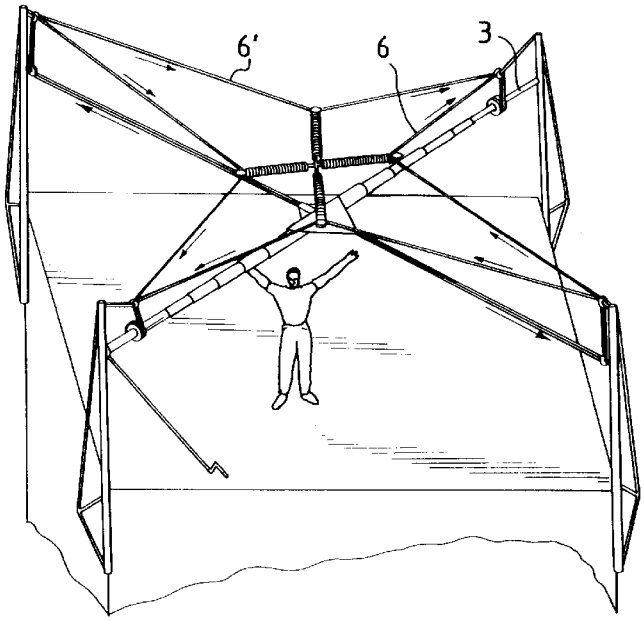

The entire awning is seated on the walls of a cubic building 17 by means of the uprights 14, 14' and 11, 11', which carry this awning or sun-shade. This can be recognized clearly from FIG. 2*a*. The plane roof of the building has been hatched horizontally in that illustration for emphasis. The shadow of a person below the rolled-in awning is contrasted thereon.

Figure 3:
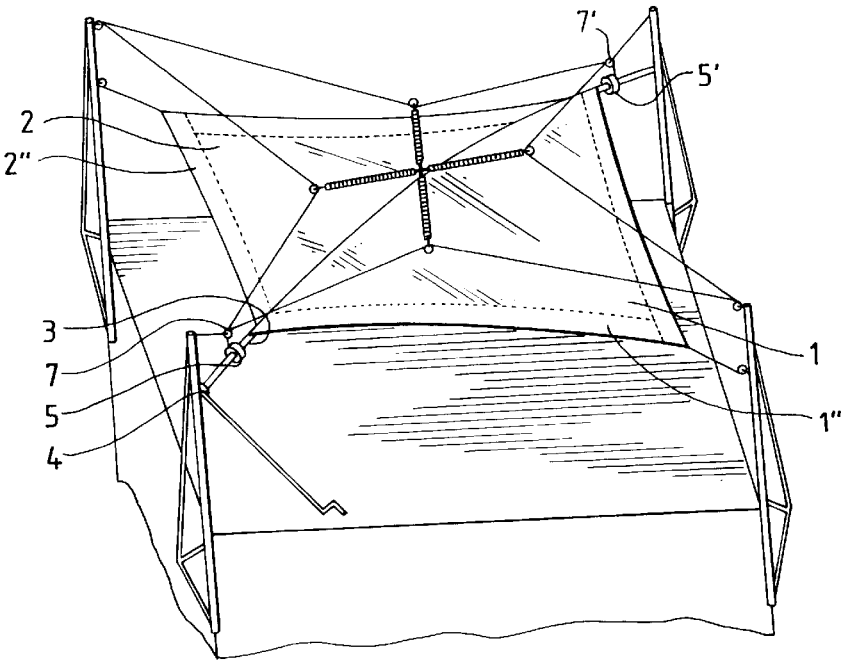

FIG. 3 shows the awning arrangement illustrated in FIG. 2 with the canvas 1, 2 extended, wherein, furthermore, the drive shaft 3 is shown to be slightly bent upwardly. This bend is desired and is the consequence of the slant traction exerted on the deviation pulleys 7, 7'. If the uprights (11, 11', 14, 14' in FIG. 2) are extended upwardly, the direction of the slant traction and thus its effect can be changed by shifting the point of engagement of the suspension of the pulleys. The greater the slant of the traction, i.e. the higher the suspension of the deviation pulleys 7, 7', the greater the natural bend of the shaft 3. Moreover, it is possible to shift the coiling pulleys 5, 5' on the shaft 3. In FIG. 3, furthermore the use of UV protective strips 1", 2" at the rims of the canvas parts 1, 2 is shown, which strips protect the more sensitive canvas in the rolled-in state.

Figure 3A:
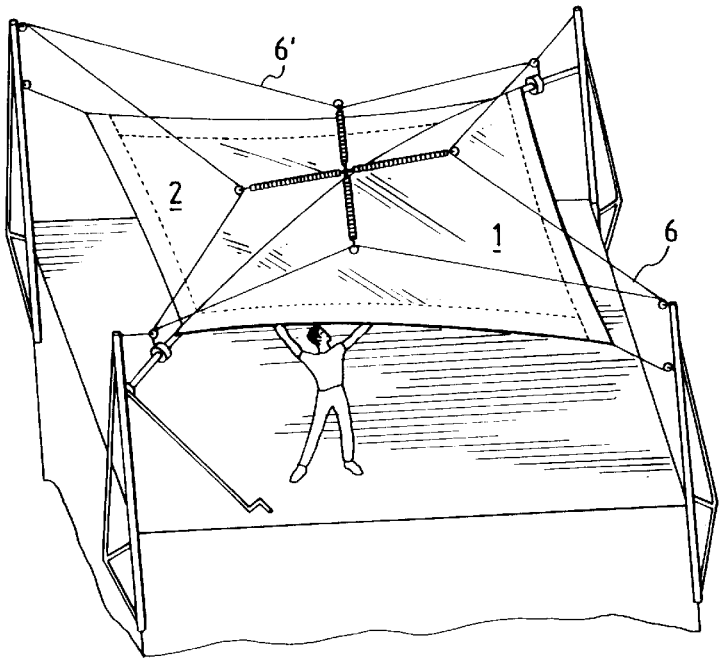

FIG. 3*a* once more illustrates the arrangement shown in FIG. 3, yet with a person standing in the shade of the canvas for better illustration. The cornered shadow of the canvas is contrasted on the hatched platform roof.

In FIG. 4, a different exemplary embodiment is illustrated, in which the drivable shaft 3, on which the canvas is rolled up, is carried by a bow or the like 18 spanning the same, which bow in turn can be fastened to the wall of a house or to a rafter by means of carriers 19, 20. In this simpler embodiment, merely one single coiling pulley 27 is used; two tensioning pulleys 25, 25' are resiliently suspended. In this manner, the shaft 3 may also be arranged so as to cantilever over parts of the building lying therebelow. Thus, the canvas may, e.g., span a small yard and a platform roof. Accordingly, this embodiment may be used for a large variety of purposes.

FIG. 5 shows a preferred embodiment of the coiling pulley whose pulley body 31 is not completely cylindrical but slightly conical. Depending on the materials of pulley and rope, the angle between a generatrix 30 of the envelope of the cone and the axis of the shaft 3 ranges between almost 0° and 2°. Preferred is an angle of 0.5°. By this, an automatic moving on of the windings coming from the (right-hand in FIG. 5) starting region of larger diameter, i.e. of the windings coiled up there, along the pulley body 31 is attained. Thus, in contrast to known coiling pulleys, it is not necessary to shift the roller itself or to shift the point at which the rope is supplied to get the windings to lay themselves precisely one beside the other. The pulley according to FIG. 5 furthermore at one end has an end plate 32 of larger diameter into which it merges with a curvature. This curvature is denoted by 33. By 34 and 35, respectively, two ropes are denoted which are guided over a pulley 36. On the surface of the drum, i.e. on the jacket of the pulley, the windings lie closely adjacent each other. At 37 the ropes 34, 35 are fastened to an oppositely arranged end plate 38. Upon rotation of the pulley, the two ropes 34, 35 run up on the thicker end, rounded, at 33, adjacent the end plate 32 and slide one next to the other on the roller body 31 towards the smaller diameter. Thus, the windings slowly slide towards the other end plate 38. The winding pulley or drum according to FIG. 5 is fastened by its axis of rotation e.g. to a wall 39 or to an upright. Steel wire, e.g., is suitable as the material to be used for the ropes 34, 35, and polyamide as the material to be used for the drum. Each rope consists of a number (e.g. 19) of twisted wires. The rope thickness depends on the load carrying capacity desired.

The coiling pulley may house an electric motor in a manner known per se to drive the same.

In FIGS. 6 and 7, the already previously mentioned chafe protection strip 24 is shown in more detail and with thickened rims 24' between which the rope coiled up together with the respective canvas part comes to lie. FIG. 7 schematically illustrates a cross-section through the chafe protection strip 24 with a rope lying thereon.

In FIG. 8 which again shows the generation of a tension bending the shaft 3, a drive is again denoted by 4 and one deviation pulley each by 7 and 7', respectively. Here, however, the latter are braced by means of a short rope to a higher point on the respective upright 14 and 14', respectively. In an analogous manner, the tensioning ropes 6, 6' are guided from the respective coiling pulley 5 or 5', respectively, over the deviation pulley 7 or 7', respectively which is tensioned upwards with slant to the upright 14 or 14', respectively. By this, the shaft 3 is slightly bent upwardly. By shifting the coiling pulley 5 or 5', respectively, on the shaft 3, the bending moment acting on the shaft 3 can be changed. Moreover, the local displacement of the coiling pulleys 5, 5' allows for an equalization of the bias at the tensioning ropes 6, 6'. This effect can be further influenced by shifting the point of engagement of the suspension of the deviation pulleys 7, 7'.

FIG. 9 shows the suspension of a deviation pulley 42 on an articulately mounted carrier 40 which is braced relative to a fixed point and formed by a tube, at whose upper end a retention device 41 is located which is inserted in the carrier tube. A similar retention device is illustrated in FIG. 10. A retention element 41 inserted in the carrier tube has a number of bores 42 through which the tensioning ropes can be guided which are provided with swaged-on clamps 43 at the inner side so as to prevent the respective rope from slipping through.

FIG. 11 shows an awning arrangement which at least at present is particularly preferred, in which a cantelevering carrier 43 carries two deflection pulleys 44, 45, by which the entire tensioning rope devices 6, 6' with the deviation pulleys 46, 47 arranged above the sun-shade as well as the—in this case single—spring 48 are held sufficiently high. The angle between the cantilevering carrier 43 and the shaft 3 is approximately 30°. The two deviation pulleys 44, 45 and also the fastening device of the single spring 48 are displaceable. Departing from point 49, also two springs may be provided, one acting on the deviation pulley 46 and the other one acting on the deviation pulley 47 so as to maintain the tension of the sun-shade. To the rims of the canvas, protective strips are attached in a manner known per se, which completely cover the canvas itself in the rolled-in state. The shaft 3 with the coiling pulley 5 may be mounted at the one end, below the cantilevering carrier 43, in Cardan manner, whereas it is preferably held so as to be longitudinally displaceable at the other end—in view of the bend occurring during operation.

In FIG. 12 a strap is illustrated in axonometric view which serves to connect the canvas tip with the associated tensioning rope 6 or 6'. A slotted bolt 63 is stuck in a double loop 62 made of a strong fabric. The loop 62 is fastened to the traction tip of the canvas. After having been provided with the swaged-on clamps 66, 66', the tensioning rope 6 or 6' is inserted into the slit 64 of the bolt 63 when the latter is inserted, these clamps 66, 66' holding together a rope loop 67.

Actuation of the device, i.e. unfolding or rolling in the sun-shade or, generally, the awning, may be effected under the control of a computer program, so that, e.g. at certain times and/or at certain weather conditions, the canvas will be rolled out or rolled in automatically. For this, sensors known per se can be used in a circuit known per se.

We claim:

1. A size-variable awning comprising:

two canvas parts fastened to a shaft that is rotatably mounted on carriers and provided with a single drive, the canvas parts being capable of being wound up on the shaft, at least two tensioning ropes winding up and unrolling the canvas parts, said tensioning ropes engaging on the canvas parts and being capable of being coiled up on at least one coiling pulley seated on the shaft, said tensioning ropes together with said single shaft holding said canvas parts when unrolled, said canvas parts being free of any lateral guide means, and at least one elastic element for compensating for different uncoiling lengths of the tensioning ropes, and for tensioning said ropes.

2. An awning according to claim 1, wherein the tensioning ropes engage on the canvas parts at points which lie on one and the same line which extends at a right angle to the shaft.

3. An awning according to claim 1, wherein the tensioning ropes engage on the canvas parts at points which lie on two different lines which extend in parallel to each other and at a right angle to the shaft.

4. An awning according to claim 1 wherein in the unrolled state, the canvas parts are offset relative to each other at the folding line.

5. An awning according to claim 1 or 2 wherein said two canvas parts are symmetrical to each other.

6. An awning according to claim 1 wherein said two canvas parts are differently sized.

7. An awning according to claim 2 wherein said two canvas parts are of equal size, yet offset relative to each other at the shaft.

8. An awning according to claim 1 wherein the canvas parts are triangular.

9. An awning according to claim 1 wherein the elastic element is a helical spring.

10. An awning according to claim 1 or 9 wherein the elastic element is arranged such that it draws the tensioning ropes towards each other.

11. An awning according to claim 10 wherein a single elastic element is provided, two deviation pulleys being attached to this elastic element, one tensioning rope each being guided thereover.

12. An awning according to claim 11 wherein the elastic element has a point of attachment which is adjustable in terms of height above the shaft, and wherein the two tensioning ropes are guided to one single coiling pulley over guiding rollers fastened to a cantilevering carrier so that the tensioning ropes leading to the coiling pulley are held sufficiently high above the awning.

13. An awning according to claim 1 wherein two said elastic elements are arranged such that they draw the two tensioning ropes towards each other, each elastic element at each end thereof being connected with one of the tensioning ropes via a respective tensioning pulley fastened thereto.

14. An awning according to claim 1 wherein laterally on two opposing lateral sides of the canvas parts one said coiling pulley each is fastened to the shaft, one respective tensioning rope departing from each of the two coiling pulleys to which the respective tensioning rope is fastened, each of the two tensioning ropes being guided over a respective deviation pulley which is suspended at a fixed point to a respective tensioning pulley which is connected to the elastic element, the tensioning pulleys resiliently drawing the two tensioning ropes towards each other, each said tensioning rope being further guided via a deviation pulley suspended at a further fixed point to a respective tensioning pulley fastened on the respective canvas part, and from there extending via a respective further deviation pulley and a further tensioning pulley to the other coiling pulley.

15. An awning according to claim 14 wherein the two tensioning ropes have similar and symmetrical courses.

16. An awning according to claim 1 wherein the shaft is mounted in bearings at each of its two ends, one of the bearings being designed as said single drive.

17. An awning according to claim 1 wherein said single drive is a motor.

18. An awning according to claim 1 wherein said single drive is a manual drive.

19. An awning according to claim 1 wherein the shaft is mounted on a bow spanning the former, said bow in turn being held by fixedly attached carriers.

20. An awning according to claim 19 wherein only one coiling pulley is seated on the shaft, each tensioning rope departing from said coiling pulley and extending via a deviation pulley to a respective tensioning pulley and further on to a deviation pulley seated at a fixed point and from there to the respective canvas part.

21. An awning according to claim 1 wherein the canvas parts are capable to be held with respect to one another at an angle deviating from 180°.

22. An awning according to claim 1 wherein each of the at least two tensioning ropes departing from a respective coiling pulley, at first is guided over a pulley which is suspended above the shaft, the tension in the tensioning rope being chosen such that a desired bend of the shaft is attained.

23. An awning according to claim 1 wherein the tensioning ropes are guided over deviation pulleys and tensioning pulleys which comprise stationary side plates arranged laterally of the pulley proper and having a substantially larger diameter than the latter, to prevent the rope from escaping.

24. An awning according to claim 1 wherein four uprights carrying the canvas parts and the tensioning ropes are provided, two diagonally oppositely arranged uprights carrying the single shaft, and the two other uprights carrying rope pulleys.

25. An awning according to claim 24 wherein the uprights are guyed poles.

26. An awning according to claim 1 wherein the at least one coiling pulley is locally displaceable.

27. An awning according to claim 1 wherein for each of the at least two tensioning ropes at least one pre-determined breaking point is provided to protect the awning against an excessive load.

28. An awning according to claim 1 wherein the shaft, on at least one of its ends, is displaceably mounted.

29. An awning according to claim 1 wherein the shaft, on at least one of its ends, is cardanically mounted.

30. An awning according to claim 1 wherein the canvas parts have different lengths, and wherein a chafe protection strip is provided on the longer canvas part, on which strip the tensioning rope of the shorter canvas part coils up.

31. An awning according to claim 1 wherein each canvas part is provided with rim protection strips which are dimensioned such that they cover the canvas part in the rolled-in state.

32. An awning according to claim 1 wherein the at least one coiling pulley is slightly conical in respect of its axis of rotation and wherein at its larger end the coiling pulley merges with a curvature into an end plate of larger diameter, and wherein the rope to be coiled up is fed along the end plate in the region of the largest diameter of the curvature, the rope to be coiled up being attached at the smaller end of the at least one coiling pulley.

33. An awning according to claim 32 wherein the conical coiling pulley has a cone angle relative to the axis of less than 1°.

34. An awning according to claim 1 wherein the tensioning ropes are guided over pulleys having several flutes.

35. An awning according to claim 1 wherein the at least one coiling pulley comprises an inwardly arranged electric motor driving an external jacket of the coiling pulley.

36. An awning according to any one of claims 32 to 34 wherein the sliding capacity of the tensioning rope to be coiled up is matched to the sliding capacity of the coiling pulley and the radius of curvature of the transition from the coiling pulley to the end plate so that the rope windings at the largest diameter of curvature create a sufficiently high pressure force directed axially onto the already previously coiled up rope windings, whereby these rope windings are continuously pushed towards the smaller end of the coiling pulley.

37. An awning according to claim 1 wherein anchoring ropes are fastened to uprights of tube-shaped configuration by means of plugs inserted in the ends of the tube-shaped uprights, which plugs engage over said ends and comprise a number of bores, the anchoring ropes being guided through these bores and provided with pressed-on sleeves below the bores, said sleeves preventing the anchoring ropes from slipping out.

38. An awning according to claim 1 wherein for fastening the tensioning ropes to the canvas parts, double straps fastened to the canvas parts are provided through which a slotted bolt is inserted, the respective tensioning rope being inserted in the slot thereof and being provided with pressed-on sleeves therebehind which hold together a rope loop.

39. An awning according to claim 1 wherein the shaft consists of a tube comprising a groove, the canvas parts being fastened to the tube by means of a rand-type strap inserted in the groove.

* * * * *